US009887050B1

(12) United States Patent
Cox et al.

(10) Patent No.: US 9,887,050 B1
(45) Date of Patent: Feb. 6, 2018

(54) CIRCUIT BREAKERS WITH METAL ARC CHUTES WITH REDUCED ELECTRICAL CONDUCTIVITY OVERLAY MATERIAL AND RELATED ARC CHUTES

(71) Applicant: Eaton Corporation, Cleveland, OH (US)

(72) Inventors: Jeffrey Michael Cox, Venetia, PA (US); Jeffrey Wayne Lockhart, Pittsburgh, PA (US); Edward Lias, Aliquippa, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 15/343,346

(22) Filed: Nov. 4, 2016

(51) Int. Cl.
*H01H 9/36* (2006.01)
*H01H 9/44* (2006.01)

(52) U.S. Cl.
CPC ..... *H01H 9/362* (2013.01); *H01H 9/44* (2013.01); *H01H 2009/365* (2013.01)

(58) Field of Classification Search
CPC ..... H01H 9/34; H01H 9/362; H01H 9/44; H01H 2009/365
USPC ... 218/34, 37, 38, 41, 46, 81, 103, 149–151, 218/156
See application file for complete search history.

(56) References Cited

U.S. PATENT DOCUMENTS 2,769,066 A * 10/1956 Cellerini ..... H01H 73/18 218/22
2,898,427 A * 8/1959 Nadeau ..... H01H 73/18 218/156
3,071,666 A 1/1963 Ellsworth et al.
3,242,257 A 3/1966 Jones et al.
3,761,660 A 9/1973 Jones
4,081,852 A 3/1978 Coley et al.
4,503,408 A 3/1985 Mrenna et al.
4,736,174 A 4/1988 Castonguay et al.
4,786,885 A 11/1988 Morris et al.
4,866,226 A 9/1989 Hisatsune et al.
4,950,852 A 8/1990 Goldman et al.
4,975,551 A 12/1990 Syvertson
5,117,211 A 5/1992 Morgan et al.
(Continued)

OTHER PUBLICATIONS

American Society for Testing and Materials "Standard Test Method for Total Mass Loss and Collected Volatile Condensable Materials from Outgassing in a Vacuum Environment" *ASTM Designation: E* 595-93 (8 pages) (1993).

(Continued)

*Primary Examiner* — Renee S Luebke
*Assistant Examiner* — William Bolton
(74) *Attorney, Agent, or Firm* — Myers Bigel, P.A.

(57) ABSTRACT

Circuit breakers with a metal arc chute having a base and sidewalls extending outward from the base forming an open cavity, a movable arm holding a movable contact adjacent to the arc chute, a line conductor electrically connected to a stationary contact residing adjacent to the arc chute facing the movable contact and a overlay material of reduced electrical conductivity attached to the arc chute and residing in the cavity of the arc chute between the stationary and movable contacts. The overlay material can be a solid three-dimensional shaped insert/molded member with a cavity and/or an overmolded material directly attached to the metal arc chute.

21 Claims, 8 Drawing Sheets

(56) References Cited

U.S. PATENT DOCUMENTS

| | | | | |
|---|---|---|---|---|
| 5,326,947 | A | 7/1994 | Edds et al. | |
| 5,359,174 | A | 10/1994 | Smith et al. | |
| 5,589,672 | A | 12/1996 | Uchida et al. | |
| 7,094,986 | B2 | 8/2006 | Shea | |
| 7,285,742 | B2 * | 10/2007 | Kinzler | H01H 71/0207 218/34 |
| 7,674,996 | B2 * | 3/2010 | Shea | H01H 9/302 218/34 |
| 8,222,983 | B2 | 7/2012 | Zhou et al. | |
| 8,247,727 | B2 * | 8/2012 | Zhou | H01H 9/302 218/157 |
| 2005/0263492 | A1 | 12/2005 | McCoy | |
| 2013/0284702 | A1 * | 10/2013 | Hamada | H01H 9/302 218/26 |
| 2015/0348720 | A1 | 12/2015 | Smeltzer et al. | |

OTHER PUBLICATIONS

Ghunem, Refat Atef "Using the Inclined-Plane Test to Evaluate the Resistance of Outdoor Polymer Insulating Materials to Electrical Tracking and Erosion" *IEEE Electrical Insulation Magazine* 31(5):16-22 (2015).

Thangarajan et al. "A Comparison of Thermoset and Thermoplastic Arc Chutes in Molded-Case Circuit Breakers Under Fault Clearing" *IEEE Electrical Insulation Magazine* 31(2):30-35 (2015).

U.S. Appl. No. 15/647,841, Maloney et al., filed Jul. 12, 2017.

* cited by examiner

CIRCUIT BREAKERS WITH METAL ARC CHUTES WITH REDUCED ELECTRICAL CONDUCTIVITY OVERLAY MATERIAL AND RELATED ARC CHUTES

FIELD OF THE INVENTION

The present invention relates to circuit breakers.

BACKGROUND OF THE INVENTION

Circuit breakers are one of a variety of overcurrent protection devices used for circuit protection and isolation. The circuit breaker provides electrical protection whenever an electric abnormality occurs. In a typical circuit breaker, current enters the system from a power line and passes through a line conductor to a stationary contact fixed on the line conductor, then to a movable contact. The movable contact is fixedly attached to a pivoting arm. As long as the stationary and movable contacts are in physical contact, current passes between the stationary contact and the movable contact and out of the circuit breaker to down-line electrical devices.

In the event of an overcurrent condition (e.g., a short circuit), extremely high electromagnetic forces can be generated. The electromagnetic forces can be used to separate the movable contact from the stationary contact. Upon separation of the contacts and blowing open the circuit, an arcing condition occurs. The breaker's trip unit will trip the breaker which will cause the contacts to separate. Also, arcing can occur during normal "ON/OFF" operations on the breaker.

Arc chutes can be used to direct an arc away from the electrical contacts into the arc chute. The arc chute can be a shaped body with open slots and may optionally comprise a series of stacked metal plates that dissipate the energy of the arc. The arc chute is situated proximate to the stationary contact of the circuit. The arc chute can be subject to intensely high temperatures during electrical arcing events. Exposure to electrical arcing can reduce the overall lifetime of a circuit breaker by depleting silver in its contacts.

SUMMARY OF EMBODIMENTS OF THE INVENTION

Embodiments of the invention are directed to circuit breakers with overlay material having reduced electrical conductivity, optionally electrically insulating material (electrically non-conductive) overlying surfaces of a metal (electrically conductive) arc chute.

The electrically insulating material can be provided as a three-dimensional rigid or semi-rigid shaped insert comprising a thermoplastic, optionally nylon.

The overlay material can be provided as an overmolded layer on at least a portion of an upper surface of a bottom of a single piece, three-dimensionally shaped arc chute.

A circuit breaker that includes a metal arc chute having a base and sidewalls extending outward from the base forming an open cavity; a movable arm holding a movable contact adjacent to the arc chute; a line conductor electrically connected to a stationary contact residing adjacent to the arc chute facing the movable contact; and an overlay material attached to the arc chute and residing in the cavity of the arc chute. The overlay material has a significantly reduced electrical conductivity relative to the metal arc chute.

The circuit breaker of Claim 1, wherein the overlay material contacts at least a segment of a primary upper surface of the base of the arc chute and at least a segment of each of the sidewalls.

The sidewalls can terminate at a vertical height that is from about 0.1 inches to about 2 inches above the stationary contact.

The overlay material can reside on a primary upper surface of the base of the arc chute. Optionally, the overlay material has a bottom and/or sidewall with maximal thickness of 0.2 inches and a minimal thickness of 0.040 inches.

The overlay material can include or be an overlay member having a self-supportable three dimensional shape with a base and sidewalls extending outward from the base. The base of the overlay member can abut a primary upper surface of the base of the arc chute body.

The overlay member sidewalls can reside inside the cavity adjacent the sidewalls of the arc chute body.

The overlay material can be an overmolded overlay material that is attached to a primary upper surface of the base of the arc chute body.

The base of the arc chute body can include a plurality of open slots extending between the sidewalls.

The overlay material can be overmolded onto the primary upper surface and sidewalls of the chute body and extends about a perimeter edge region of the slots to leave open spaces over the slots.

The base of the arc chute body can include a plurality of open slots extending between the sidewalls. The overlay material can extend about a perimeter edge region of the slots and leave an open space over the slots.

The base of the arc chute body can include a plurality of open slots extending between the sidewalls. The overlay member can include a plurality of open slots with at least one of the slots of the overlay member aligned with at least one of the slots of the arc chute body.

The arc chute body can include first and second parallel slots that are orthogonal to the sidewalls. The overlay member can include first, second and third slots. The first and second slots can be aligned with the first and second slots of the arc chute body. The third slot can be parallel to the first and second slots of the overlay member and can be more narrow than the first and second slots of the overlay member.

The third slot of the overlay member can reside between the first and second slots of the overlay member.

The overlay member can include a fourth and a fifth slot, and the third, fourth and fifth slots can be more narrow than the first and second slots of the overlay member.

The sidewalls of the overlay member can angle outward from the base of the overlay member and abut the sidewalls of the arc chute body. The moving contact can be offset from a centerline of the arc chute and can reside closer to one of the overlay member sidewalls than another.

The overlay material can include or be a rigid or semi-rigid body that has a self supporting three dimensional shape and can include outwardly extending projections that align with upwardly extending slots in the sidewalls of the arc chute.

The overlay material can include a plurality of rigid or semi-rigid planar members that extend between the sidewalls and rise upward from the base of the arc chute to terminate below an upper end of the sidewalls.

The overlay material can be or include a polyimide.

The overlay material can be or include a comprises nylon.

The overlay material can be or include a thermoplastic with a moisture absorption that is greater than 3%, has a high outgassing rate and a heat deflection temperature (under 0.45 MPa load) that is greater than 250° C.

Other embodiments are directed to arc chutes for circuit breakers that include: a unitary metal arc chute body having a three dimensional shape with a base and first and second sidewalls with a cavity between the sidewalls above the base; and an overlay material residing in the cavity of the arc chute body, wherein the overlay material resides directly on the base and at least partially against inner surfaces of the sidewalls of the arc chute body. The overlay material can have a significantly reduced electrical conductivity relative to the metal arc chute.

The overlay material can be or include a rigid or semi-rigid overlay body with a base and sidewalls, and the base of the overlay body can reside between the sidewalls of the arc chute body over the base.

The base of the arc chute body can have a plurality of open slots extending between the sidewalls. The overlay member can have a plurality of open slots with at least one of the slots of the overlay member aligned with at least one of the slots of the arc chute body.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 1:
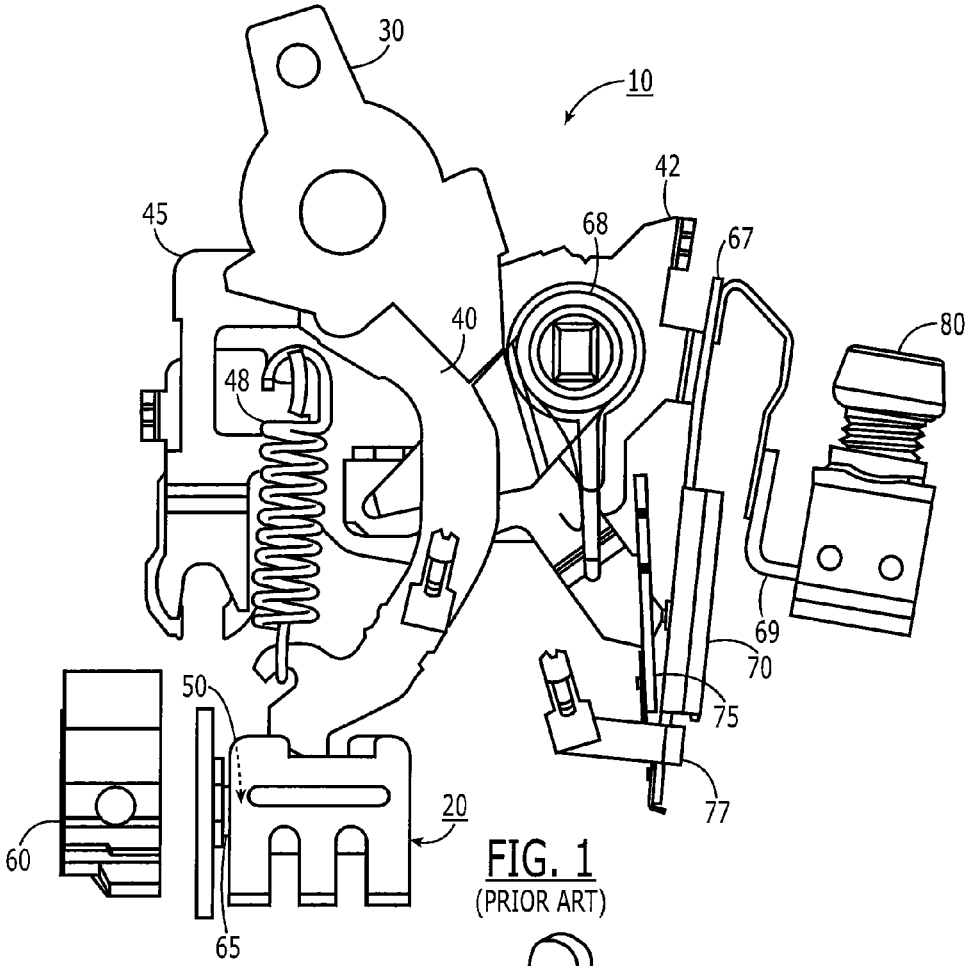
FIG. 1 (PRIOR ART)
FIG. 1 is a partial view of components of a prior art circuit breaker.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 10, 10', 10", 10''').

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art. The term "Fig." (whether in all capital letters or not) is used interchangeably with the word "Figure" as an abbreviation thereof in the specification and drawings. In the figures, certain layers, components or features may be exaggerated for clarity, and broken lines illustrate optional features or operations unless specified otherwise. In addition, the sequence of operations (or steps) is not limited to the order presented in the claims unless specifically indicated otherwise.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "bottom", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass orientations of above, below and behind. The device may be otherwise oriented (rotated 90° or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

The term "non-ferromagnetic" means that the noted component is substantially free of ferromagnetic materials so as to be suitable for use in the arc chamber (non-disruptive to the magnetic circuit) as will be known to those of skill in the art.

The term "electrically insulating" and "electrically non-conductive" are used interchangeably and mean that the noted material and/or component does not conduct a significant amount of current at normal operating voltages of the breaker and typically has a sufficiently greater electrical resistivity than the electrically conductive material of an underlying steel arc chute. That is, the breakdown voltage of the electrically insulating or electrically non-conductive material is above the normal operating range of the circuit breaker, typically by at least one order of magnitude. Breakdown voltage can be expressed in terms of electric strength (kV/mm) according to ASTM D149, IEC 60093 and/or IEC60243. For example, Stanyl TE341 has an electric strength of 25 kV/mm, several orders of magnitude greater than normal operating voltage of a (residential) circuit breaker. The breakdown voltages can meet or exceed and/or be assessed per one or both of these test procedures and can have the volume resistivity and electric strength that meets or exceeds the below values.

| Electrical properties | dry/cond | | |
|---|---|---|---|
| Volume resistivity | 1E13/1E10 | Ohm * m | IEC 60093 |
| Electric strength | 25/20 | kV/mm | IEC 60243-1 |

Resistivity is the inverse of conductivity, the resistance to the flow of current through a cross section of said material. In the above chart, an exemplary overlay material (i.e., dry nylon) has a volume resistivity of 1E13 Ohm*m, which equates to an electrical conductivity of 1E-13 S/m. Carbon steel useful for some metal arc chutes, for comparison, has a volume resistivity on the order of 1E-7 Ohm*m and an electrical conductivity of 1E7 S/m. Thus, carbon steel is roughly 20 orders of magnitude more effective for carrying current. Therefore, the term "significantly greater electrical resistivity" refers to an overlay material that is at least 5 orders of magnitude greater than a metal arc chute to which it is attached.

The term "high outgassing" refers to an outgassing rate of about 1.2E-5 Torr-L/cm$^2$s or more to quickly out gas any absorbed moisture in the material during an electrical interruption.

The overlay material can have a Total Mass Loss (TML) of about 2.38% per ASTM E595.

The term "semi-rigid" means that the device may flex under some loading but is able to hold its shape (it is self-supporting) when not attached to another member. The term "rigid" means that the device does not flex under normal loading during use.

Turning now to the figures, FIG. 1 illustrates a prior art circuit breaker 10 with an arc chute 20, a movable contact arm 40 with an electrical contact 50, a line terminal assembly 60 comprising a stationary electrical contact 65. The movable contact arm 40 engages a handle 30 and a mechanism spring 48. The circuit breaker 10 can also include at least one trip cam 68, a frame 42, a cradle 45, a bimetal member 67, a collar assembly 80, a load terminal 69, a magnet 70, armature 75 and shunt bracket 77, for example.

Figure 2:
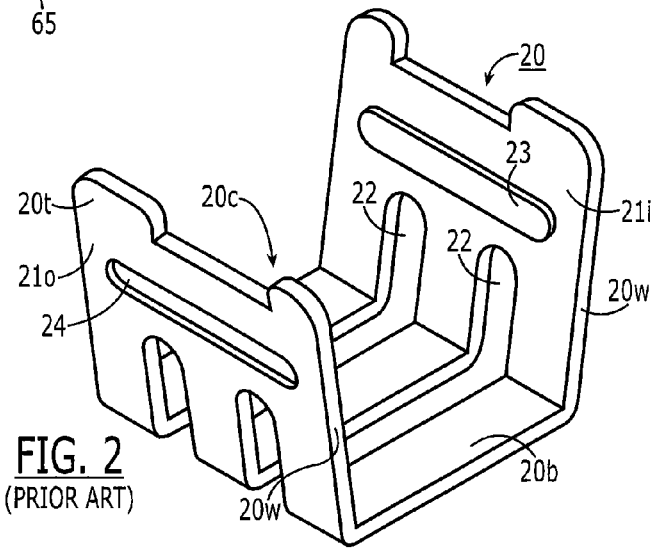
FIG. 2 (PRIOR ART)
FIG. 2 is a greatly enlarged view of a prior art arc chute shown in the circuit breaker of FIG. 1.

FIG. 2 is an enlarged view of the prior art arc chute 20 shown in FIG. 1. This arc chute 20 includes a bottom or base 20*b*, sidewalls 20*w* extending upwardly from at least two opposing sides of the base 20*b* to an upper portion 20*t* and providing a cavity 20*c*. The arc chute 20 can include slots 22 in the base 20*b* extending in a direction between the sidewalls 20*w* and which may also extend upward a partial distance into one or both of the sidewalls 20*w*. The inner surfaces 21*i* of the sidewalls 20*w* may include a projection 23 that is orthogonal to the slots 22 and the outer surfaces 210 may include a corresponding recess 24.

Figure 3:
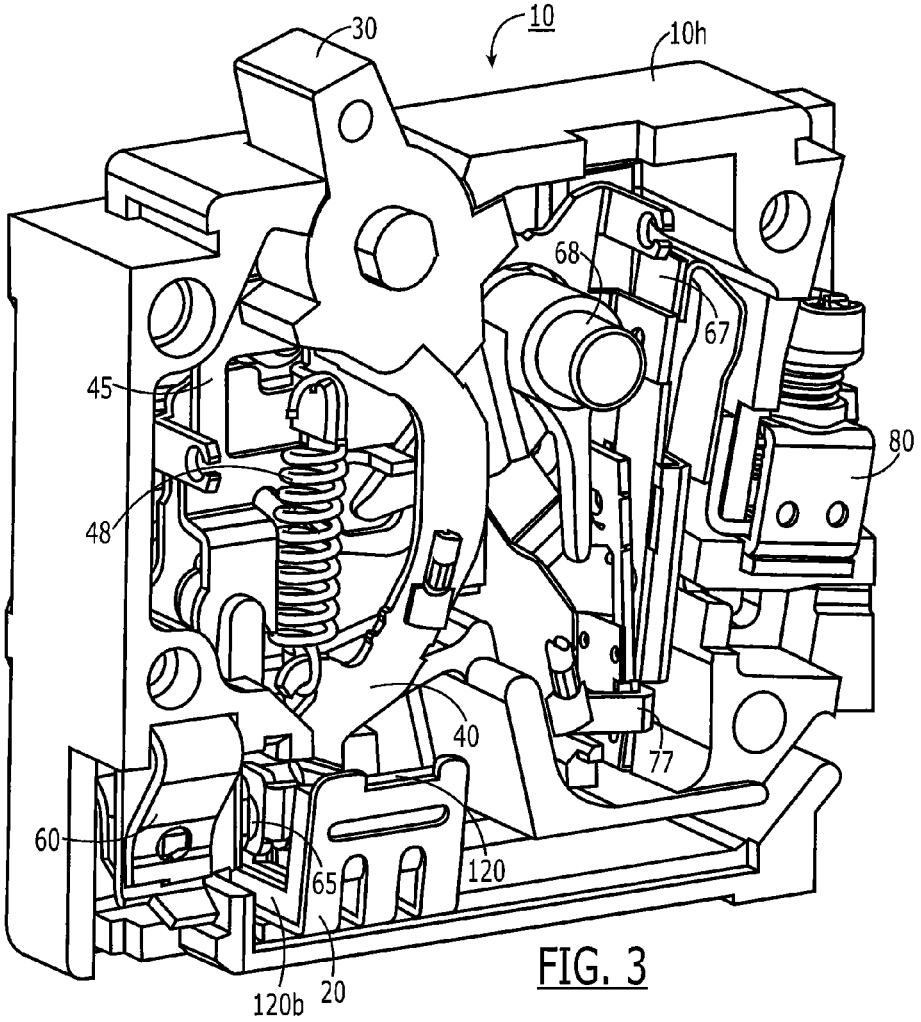
FIG. 3 is a side perspective view of a circuit breaker with an arc chute having an electrically conductive overlay member according to embodiments of the present invention.
Figure 4A:
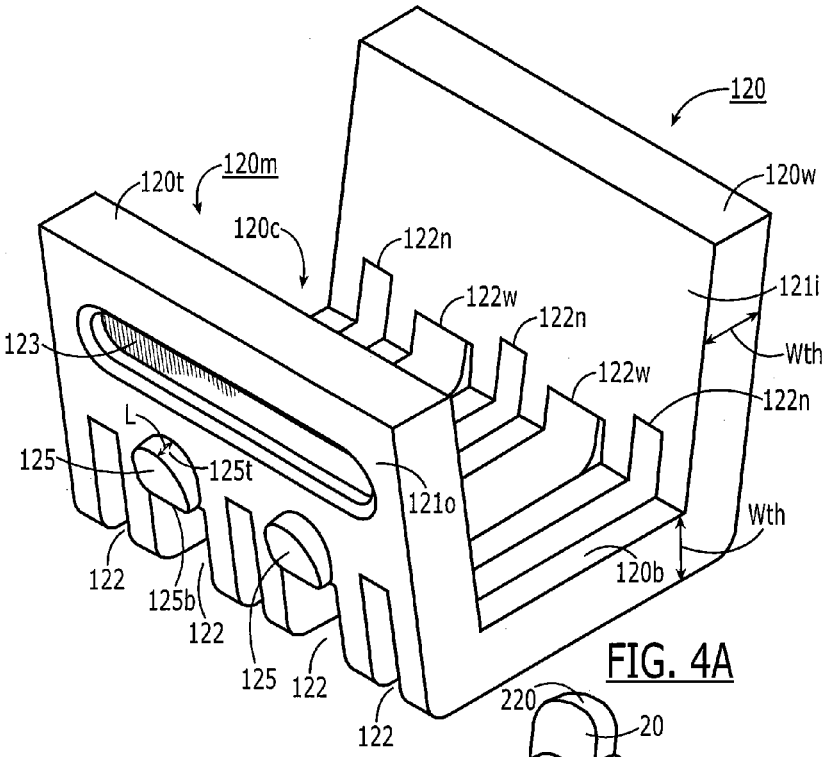
FIG. 4A is a greatly enlarged side perspective view of the overlay member shown in FIG. 3 according to embodiments of the present invention.

FIG. 3 is a partial section view of a circuit breaker 10 according to embodiments of the present invention. As shown, the circuit breaker 10 can include a molded circuit breaker housing 10*h* that holds the components discussed above. In addition, as shown in FIGS. 3 and 4A, the arc chute 20 includes an overlay material 120 directly on an upper primary surface of the base 20*b* of the arc chute 20. The arc chute 20 can have a unitary (single piece) body of steel. The arc chute 20 can have sidewalls with tops 20*t*.

Figure 4B:
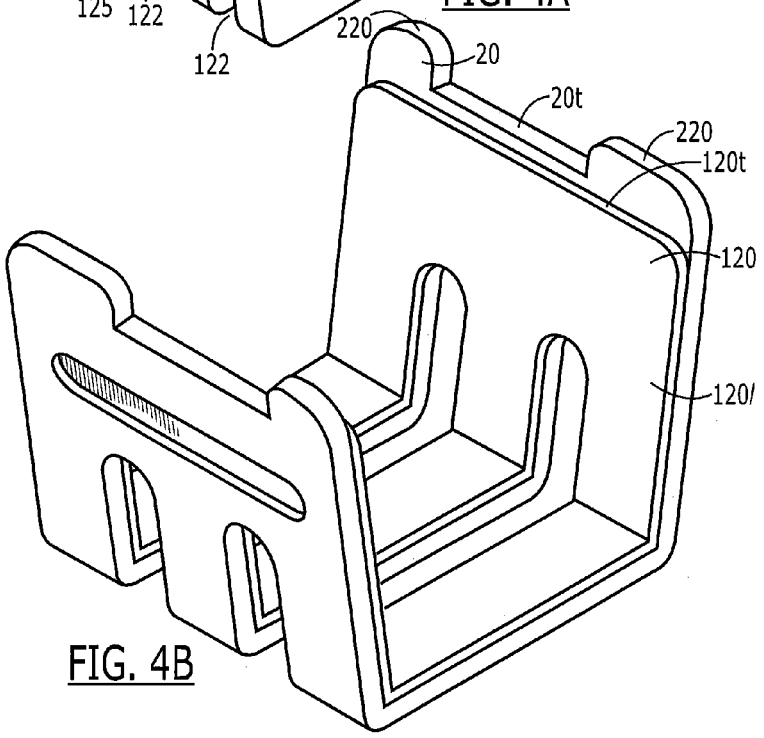
FIGS. 4B and 4C are greatly enlarged side perspective views of the arc chute shown in FIG. 3 with an integral (typically over-molded) overlay material according to embodiments of the present invention.
Figure 5:
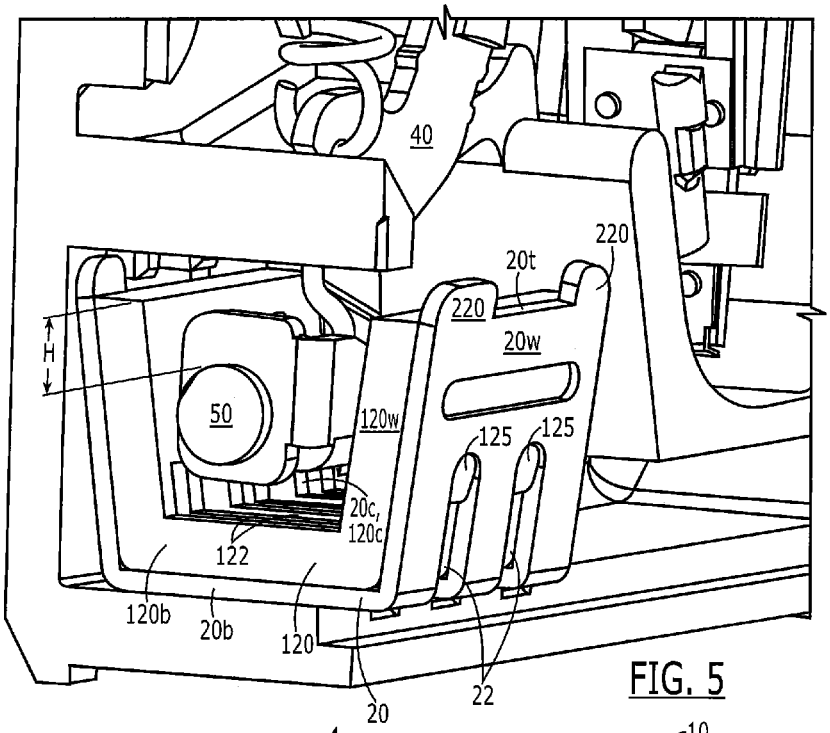
FIG. 5 is a partial section and enlarged view of the circuit breaker shown in FIG. 3 illustrating the arc chute, overlay member and contact according to embodiments of the present invention.

As shown in FIGS. 4B and 5, for example, the tops 20*t* of the arc chute 20 can include a pair of laterally spaced apart upwardly project tabs 220, one on each end of each sidewall 20*w*, in some embodiments.

Figure 6A:
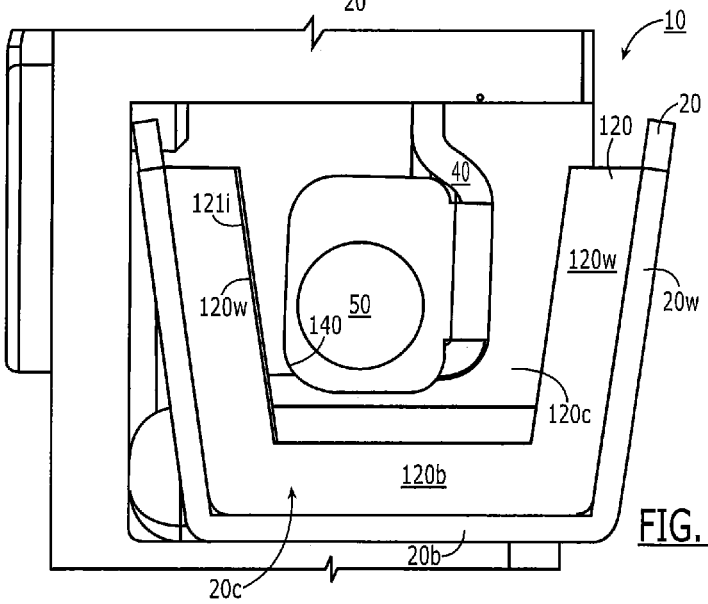
FIG. 6A is a greatly enlarged end view of the arc chute and overlay material contact arm and moving contact according to embodiments of the present invention.
Figure 6B:
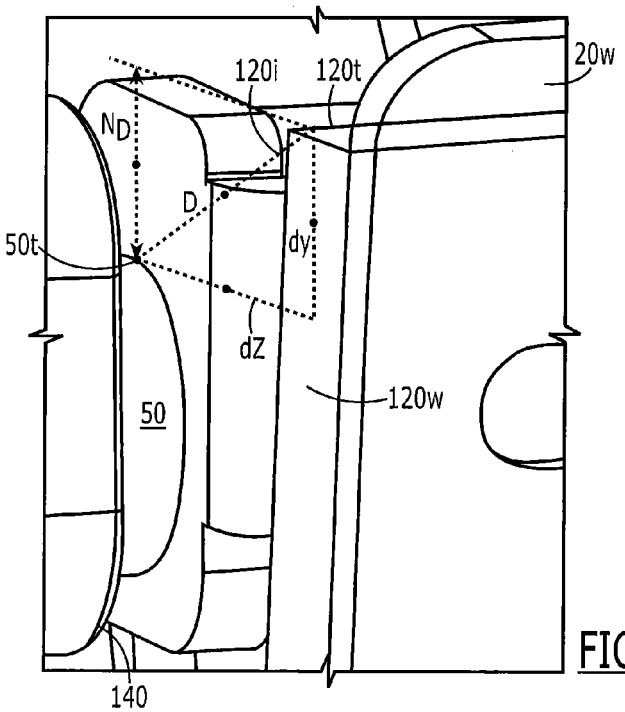
FIG. 6B is a greatly enlarged side perspective end view of the moving contact and arc chute with the overlay material according to embodiments of the present invention.

As shown in FIGS. 5, 6A and 6B, the upwardly extending sidewalls 120*w* can terminate at a vertical height "H" that is above the top or vertex of the moving contact 50, at least when the circuit breaker is ON and able to pass current. In some embodiments, the top of the moving contact 50*t* is at a distance of less than 1 inch, typically about 0.09 inches to about 0.10 inches, below the top of the sidewalls 120*w* when the circuit breaker is ON.

Figure 6C:
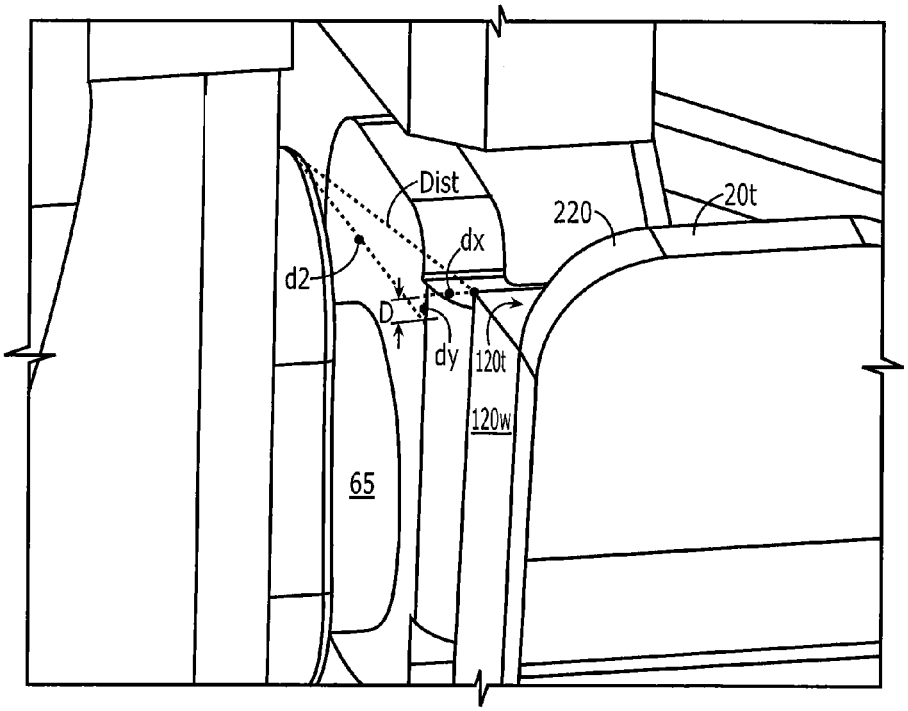
FIG. 6C is a greatly enlarged side perspective end view of the stationary contact and arc chute with the overlay material according to embodiments of the present invention.

Referring to FIG. 6C, for example, the sidewalls 120*w* of the overlay 120 can have a height sufficient to place the top

120*t* even with or above the top of the stationary contact 65, at least along a Y-axis. The overlay 120 can be configured to extend a distance "D" of about 0.01 inches to about 0.02 inches, such as about 0.0136 inches, above the top of the stationary contact 65 (along the Y-axis in the orientation shown). In some embodiments, this dimension is greater than or equal to the height of the stationary contact 65.

The sidewalls 20*w* of the arc chute 20*w* can have a height that is under 1 inch, in some embodiments, typically between 0.6 inches and 0.4 inches. The sidewalls 120*w* of the overlay 120, and/or member 120*m*, where used, can have a corresponding height or may be taller or shorter and can reside inside the cavity 20*c* of the arc chute 20 for at least a major segment of their height. In some embodiments, the sidewalls 120*w* can have a height that positions the top thereof 120*t* below the tabs 220 and parallel to the top 20*t* of the sidewalls 20*w* of the metal arc chute 20.

As shown in FIG. 4A, the overlay material 120 can be provided as a rigid or semi-rigid overlay member 120*m* having sufficient rigidity to provide a self-supportable three-dimensional shape (when not attached to the arc chute). The three-dimensional shape of the overlay member 120*m* can correspond to and/or conform to the shape of the arc chute 20 so as to provide a cavity 120*c* and upwardly extending sidewalls 120*w*. The sidewalls 120*w* may taper outward from the base 120*b* at an angle of inclination that corresponds to that of the sidewalls 20*w* of the arc chute 20.

Figure 4C:
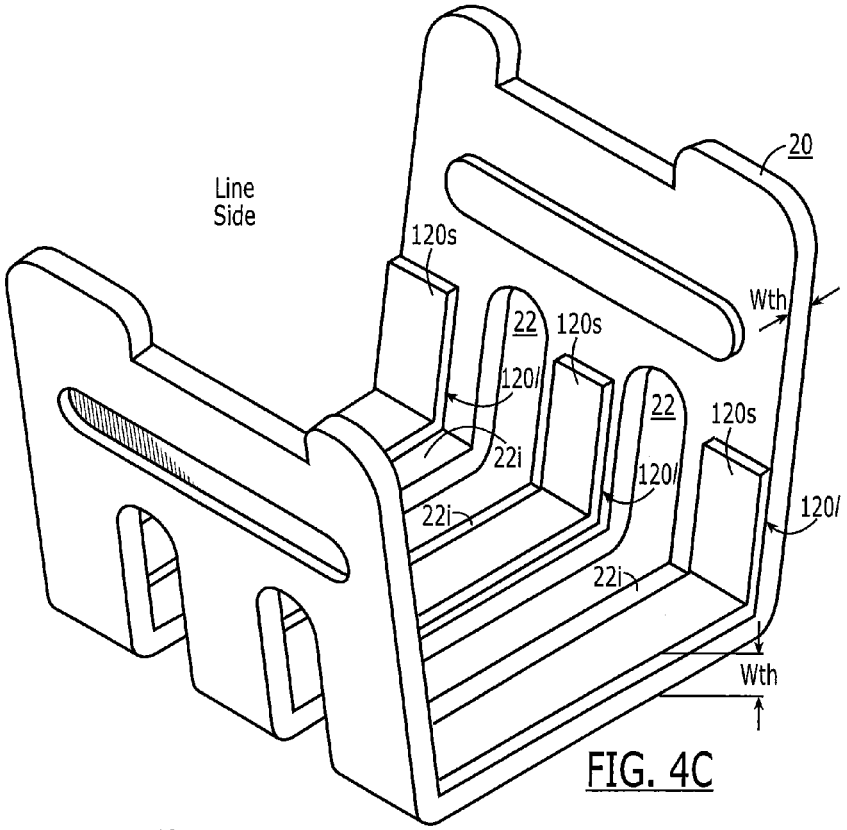

As will be discussed further below, and as shown in FIGS. 4B and 4C, for example, the overlay material 120 may alternatively be provided as an over-molded layer(s) 120*l* of material formed directly on an upper surface of base 20*b* and typically the sidewalls 20*w* of the metal arc chute 20.

The overlay material 120 has a significantly reduced electrical conductivity relative to the metal arc chute 20 and may optionally be electrically non-conductive, i.e., electrically insulating. The term "significantly reduced" means that the electrical conductivity is at least 50% less than that of the metal chute when measured at 250 degrees C.

The overlay material 120 typically comprises a polymer, such as a thermoplastic polymer which may include glass fibers and/or other materials for structural rigidity, flame retardant properties and the like. In some embodiments, the overlay material 120 is or comprises at least one polyamide such as nylon, aramid and/or an aromatic polyamide such as KEVLAR®.

Figure 4D:
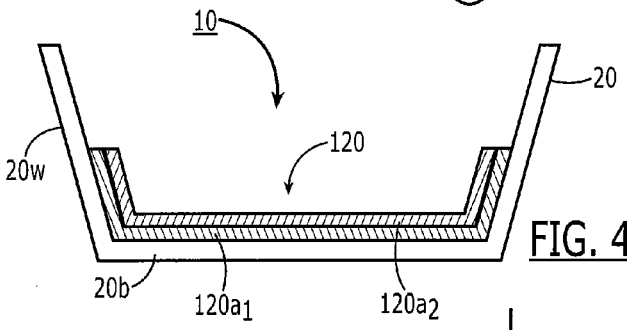
FIG. 4D is a side schematic view of a laminated or multi-layer overlay material according to embodiments of the present invention.

As shown in FIG. 4D, for example, the overlay material 120 can comprise a multi-layer structure, shown as first and second layers 120$a_1$, 120$a_2$, which may be a laminated structure of one or more materials. More than two layers may be used. The overlay material 120 can comprise a polymer 120$a_2$ as an external layer and a semiconductor 120$a_1$ (on the inner side facing the upper primary surface of the bottom of the chute 20) or combinations of these or other materials.

Figure 4E:
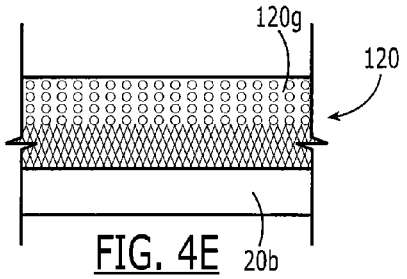
FIG. 4E is a partial section view of an arc chute with an overlay material having a gradient electrical conductivity configuration according to embodiments of the present invention.

As shown in FIG. 4E, the overlay material 120 may have a gradient configuration 120*g* of reduced electrical conductivity, such as an electrically insulating outer surface that transitions to have increased electrical conductivity (ies) in depth as the overlay material 120 approaches the (i.e., wall or primary surface of the bottom of) metal arc chute surface(s).

In some embodiments, the overlay material 120 is or comprises nylon. The overlay material 120 can be hygroscopic and have a high outgassing rate with a suitable melting temperature of above 250 degrees Celsius. As used herein, the term "hygroscopic" refers to materials with a moisture absorption value (at equilibrium) that is greater than 3% and/or a water absorption value of at least 10% as determined by ISO62.

In some embodiments, the overlay material 120 can be or comprise a PA46 grade nylon with or without fillers or other additives.

In some embodiments, the overlay material 120 can have the following properties: (a) moisture absorption that is greater than 3% according to ISO62; (b) a heat deflection temperature (under 0.45 MPa load) that is greater than 250° C. according to ISO75; and (c) a total mass loss that is greater than 2% according to ASTM595, the contents of these standards are incorporated by reference as if recited in full herein.

Referring again to FIG. 4A, the overlay material 120 can be a free standing member 120*m* with sidewalls 120*w* that extend up from a base 120*b* and a top 120*t*. In the embodiment shown, there are only two sidewalls facing each other across a cavity or depression 120*c*. The overlay member 120*m* can have a wall thickness With that is the same for the bottom or base 120*b* as the sidewalls 120*w*, as shown, or the wall thickness With may vary. The wall thickness With is typically from about 0.040 inches to about 0.100 inches, such as about 0.088 inches, in some embodiments.

The outer surface 1210 of the sidewalls of the overlay member 120*m* can include at least one (shown as two) outwardly projecting members 125 that can engage the slots 22 in the sidewalls of the arc chute 20. The projecting members 125 can be circular or arcuate and engage an upper end of the slot 22 in a respective sidewall 20*w*. The projecting members 125 can have an outwardly extending length that is less than a wall thickness With of the sidewall 20*w* of the arc chute 20. The projecting members 125 can be configured to position the outer end of the projecting member to be flush or recessed into the outer surface of the arc chute sidewall 20*w* as shown in FIG. 5, for example.

As shown in FIG. 4A, the projecting members 125 in FIG. 5 have a length L of between 0.1 inches and 0.01 inches, more typically between about 0.07 and 0.03 at the midpoint of the top surface 125*t*. The projecting member 125 can taper inward below the top 125*t* to have a shorter length at its bottom 125*b*. The projecting member 125 may have a maximal length that is about 90% of the steel arc chute's thickness. The arc chute wall thickness 20*w* can be about 0.032 inches and the projecting member(s) 125 can have a maximal length L that is about 0.029 inches, in some embodiments. In some other embodiments, i.e., for high-rating products (>100 A, typically used as a residential main circuit breaker) the have arc chute 20 can have a metal wall 20*w* with thicknesses of about 0.060 inches and the projecting member(s) 125 can have a maximal length L that is about 0.055 for a residential circuit breaker.

Still referring to FIG. 4A, the outer surface 1210 of the sidewall can include a laterally extending recess 123 that can have a shape corresponding to the laterally extending projection 23 of the arc chute (FIG. 2). In the embodiment shown, the recess 123 has an elongate linear shape between arcuate ends.

Figure 7:
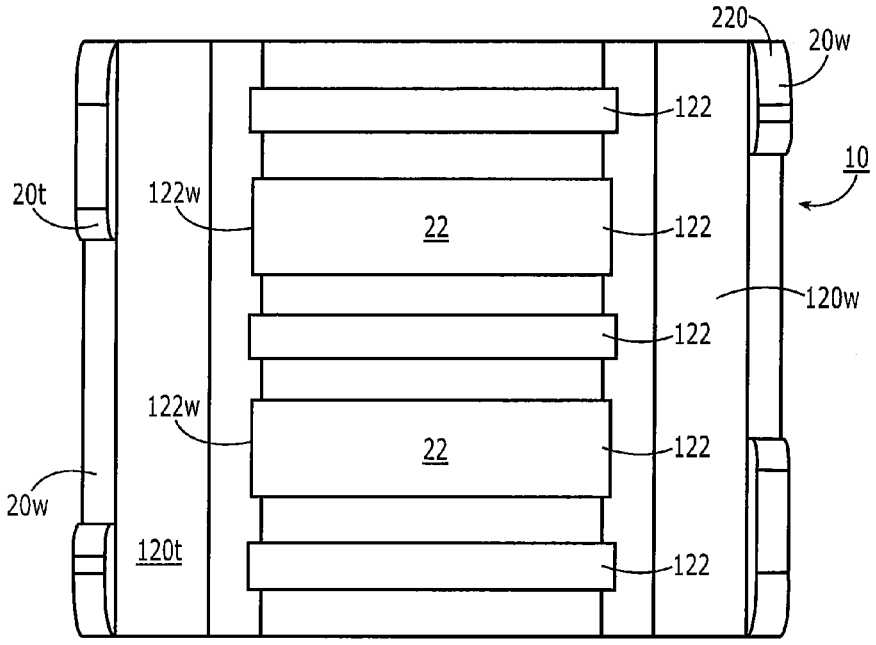
FIG. 7 is a top view of the arc chute and overlay member shown in FIGS. 3 and 4A according to embodiments of the present invention.

Referring to FIGS. 4A and 7, the overlay member 120*m* can include a plurality of adjacent and spaced apart slots 122 (shown as four). The slots 122 can be provided as alternating slots of different widths, two more narrow 122*n* than the other wider two 122*w*. The wider slots 122*w* can align with the underlying slots 22 of the arc chute 20. The slots can have different shapes and lengths.

Arc chutes attempt to channel the arc away from the stationary and moving contacts 65, 50, respectively, during a short circuit fault. After the magnetic trip occurrence, this channeling helps keep the fault's closing time to one half-cycle, extending the life of the contacts by depleting less silver. The slots 22 in the (typically stamped) steel arc chute 20 can aid in splitting the initial arc into multiple-smaller arcs, encouraging current along the arc chute to jump surfaces. The slots 122 can allow steel of the underlying arc chute to be exposed. The slots 122 can be wider and/or longer than aligned slots 22 of the arc chute to expose more steel.

As shown in FIGS. 3, 5, 6A and 6B, for example, the base 120*b* of the overlay member 120*m* can reside directly on the upper surface of the base of the arc chute 20*b*. Referring to FIGS. 5 and 6A, the overlay material 120 can occupy what was otherwise free space in the cavity of the arc chute 20*c*. The movable contact 50 can reside closer to one sidewall 120*w* than the other sidewall as shown in FIG. 6A.

In some particular embodiments, as shown in FIG. 6A, for example, the contact arm 40 can be biased towards the base or cradle 45 (FIG. 3) of the circuit breaker 10. In some embodiments, the overlay material 120 can direct the arc towards one side, such as the cover side. In some embodiments, there is less than 0.10 inches in clearance, such as only about 0.040 inch clearance, between the inner surface 121*i* of one of the sidewalls 120*w* and the end of the contact arm 140 with the contact 50.

FIG. 6B illustrates that the top of the moving contact 50*t* can reside closely spaced apart from the inner surface/top of the overlay material during an ON position of the circuit breaker, typically within a normal/orthogonal distance that is less than 1 inches, more typically about 0.1 inches or less, such as at a normal distance $N_D$ of about 0.094 inches from a top of the overlay material 120*t*. The vertex or top of the moving contact 50*t* can reside a distance dz that is about 0.25 inches, a distance dy that is about 0.094 inches and a distance D extending from the vertex of the moving contact 50*t* to the top inner surface 120*i* of the overlay material of less than 0.5 inches, typically about 0.27 inches.

Referring to FIGS. 4B and 4C, the overlay material 120 can be integrally attached to the arc chute 20 as an over mold layer 120*l*, typically with a thickness of from about 0.040 inches to about 0.100 inches, such as about 0.088 inches, in some embodiments.

The overmolded overlay 120*l* and arc chute 20 can be configured as a unitary body so that the overlay material 120 is not easily manually detachable and can, in some embodiments, require a peel strength above 1 KN/m, and more typically above about 3 KN/m, and/or unless by destructive detachment to destroy the intact configuration of the overlay 120.

FIG. 4B illustrates that the overmolded overlay material 120*l* can occupy an entire surface area of the base 20*b* and more than a major (greater than 50%) of the surface area of the sidewalls 20*w*. The inner surface areas 22*i* of the perimeter of the slots 22 may be free of the overlay material to expose metal, typically leaving at least over a thickness dimension of the base 20*b* free of the overlay material 120*l*.

As shown in FIG. 4C, the overlay 120*l* can be provided as disconnected elongate segments that occupy a sub-surface of the metal of the underlying surface in the arc chute base 20*b*. The segments 120*s* can reside on each outer side of the arc chute base and a portion of the sidewalls 20*w* and leave inner perimeters 22*i* of the slots 22 uncovered.

Figure 8:
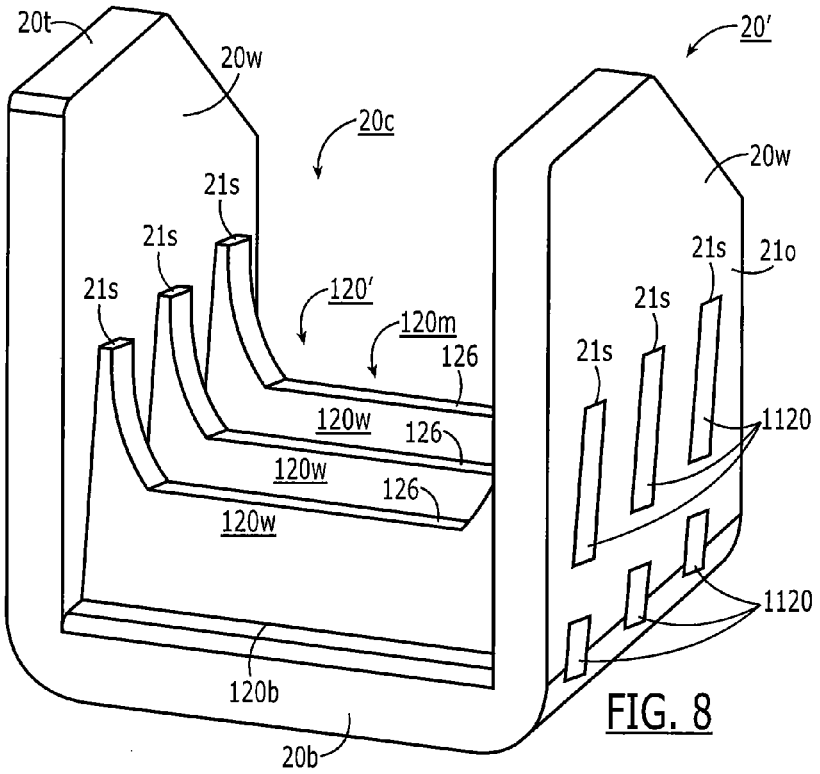
FIG. 8 is a side perspective view of another embodiment of an arc chute with electrically insulating overlay material according to embodiments of the present invention.
Figure 9:
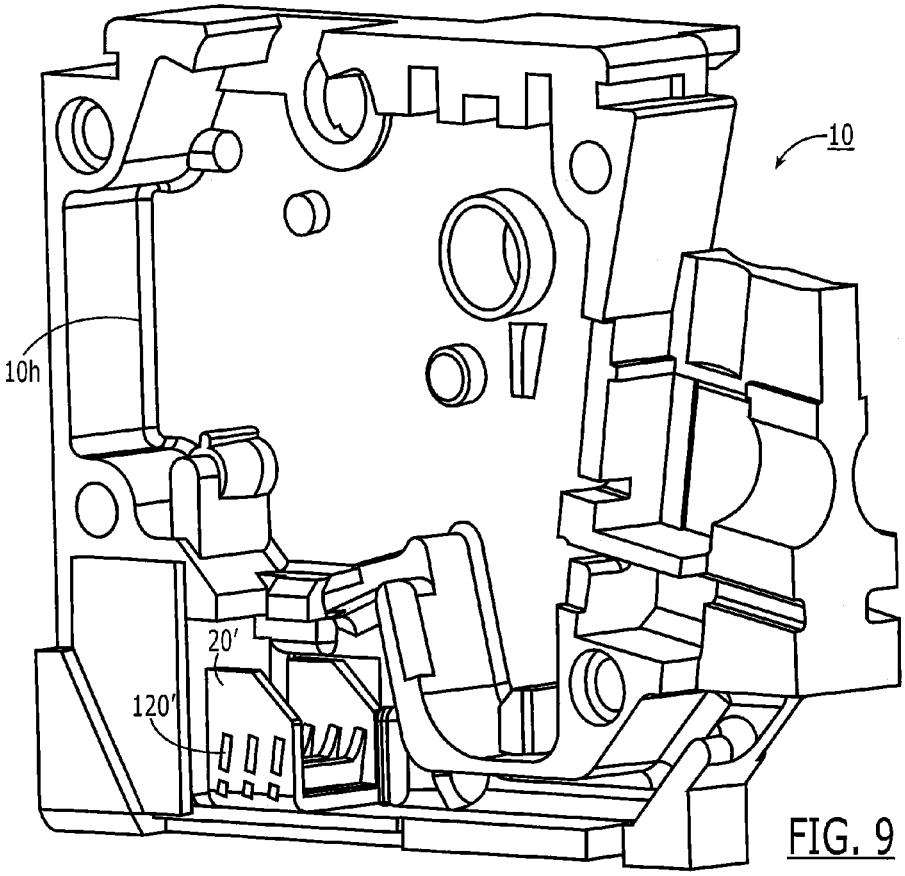
FIG. 9 is a side partial section view of the circuit breaker with the arc chute and overlay material shown in FIG. 8 according to embodiments of the present invention.

FIGS. 8 and 9 show another exemplary embodiment of the arc chute 20' and overlay material 120'. In this embodiment, the overlay material can comprise an overlay member or members 120*m* with a plurality of rigid or semi-rigid planar members (similar to fins) 120*f* with walls 120*w* that extend between the sidewalls 20*w* of the arc chute 20 in the cavity 20*c*, rise upward from the base of the arc chute 20*b* and terminate below an upper end of the sidewalls 20*t*. The members 120*m* can be provided as a plurality of discrete members that interlock or attach to slots 21*s* in the sidewalls 20*w* with interlock end segments 1120. The overlay member 120*m* may also be provided as a unitary member of connected wall segments 120*w*. The overlay member 120*m* can have a plurality of a parallel planar wall segments that rise up at the sidewalls of the base 20*w* and the planar segments 126 can extend at a height that is below about half the maximal height of the sidewalls 20*w*.

Figure 10A:
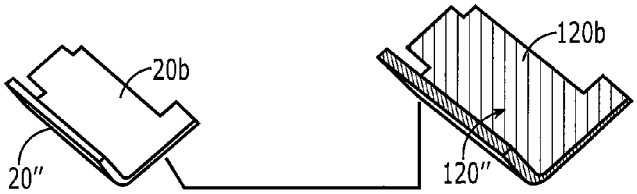
FIG. 10A is a top perspective view of another an arc chute and overlay material configuration according to embodiments of the present invention.
Figure 10B:
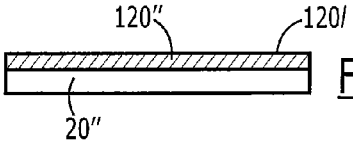
FIG. 10B is a partial top view illustrating the cooperating members of FIG. 10A assembled together according to embodiments of the present invention.

FIGS. 10A and 10B show yet another embodiment of an arc chute 20" and overlay material 120". The arc chute 20" can have a solid, continuous base surface 20*b* and the overlay 120" can cover and/or encapsulate the upper primary surface of the base 20*b*.

The contacts 50, 65 can comprise about 25% Ag to about 97% Ag by weight. In some embodiments, the circuit breakers 10 can be DC circuit breakers, AC circuit breakers, or both AC (alternating current) and DC (direct current) circuit breakers.

The circuit breakers 10 can be rated for voltages between about 1V to about 5000 volts (V) DC and/or may have current ratings from about 15 to about 2,500 Amps. The circuit breakers 10 may be high-rated miniature circuit breakers, e.g., above about 70 A in a compact package. However, it is contemplated that the circuit breakers 10 and components thereof can be used for any voltage, current ranges and are not limited to any particular application as the circuit breakers can be used for a broad range of different uses.

The circuit breakers 10 can be molded case circuit breakers (MCCB)s. MCCBs are well known. See, e.g., U.S. Pat. Nos. 4,503,408, 4,736,174, 4,786,885, and 5,117,211, the contents of which are hereby incorporated by reference as if recited in full herein.

The circuit breakers 10 can be a bi-directional DC MCCB. See, e.g., U.S. Pat. No. 8,222,983, the content of which is hereby incorporated by reference as if recited in full herein. The DC MCCBs can be suitable for many uses such as data center, photovoltaic, and electric vehicle applications.

As is known to those of skill in the art, Eaton Corporation has introduced a line of MCCBs designed for commercial and utility scale photovoltaic (PV) systems. Used in solar combiner and inverter applications, Eaton PVGard™ circuit breakers are rated up to 600 Amp at 1000 Vdc and can meet or exceed industry standards such as UL 489B, which requires rigorous testing to verify circuit protection that meets the specific requirements of PV systems. However, it is contemplated that the circuit breakers 10 can be used for various applications with corresponding voltage capacity/rating. In some particular embodiments, the circuit breaker 10 can be a high-rating miniature circuit breaker.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed:

1. A circuit breaker, comprising:

a metal arc chute having a base and sidewalls extending outward from the base forming an open cavity;

a movable arm holding a movable contact adjacent to the arc chute;

a line conductor electrically connected to a stationary contact residing adjacent to the arc chute facing the movable contact; and an overlay material attached to the arc chute and residing in the cavity of the arc chute, wherein the overlay material has a significantly reduced electrical conductivity relative to the metal arc chute, wherein sidewalls of the overlay material terminate at a vertical height that is from about 0.1 inches to about 2 inches above the stationary contact, and wherein the overlay material resides on a primary upper surface of the base of the arc chute.

2. The circuit breaker of claim 1, wherein the overlay material contacts at least a segment of a primary upper surface of the base of the arc chute and at least a segment of each of the sidewalls.

3. The circuit breaker of claim 1, wherein the overlay material has a bottom and/or sidewall with maximal thickness of 0.2 inches and a minimal thickness of 0.040 inches.

4. The circuit breaker of claim 1, wherein the overlay material comprises an overlay member having a self-supportable three dimensional shape with a base and sidewalls extending outward from the base, and wherein the base of the overlay member abuts a primary upper surface of the base of the arc chute body and the overlay member sidewalls reside inside the cavity adjacent the sidewalls of the arc chute body.

5. The circuit breaker of claim 4, wherein the base of the arc chute body comprises a plurality of open slots extending between the sidewalls, wherein the overlay member comprises a plurality of open slots with at least one of the slots of the overlay member aligned with at least one of the slots of the arc chute body.

6. The circuit breaker of claim 1, wherein the overlay material is an overmolded overlay material that is attached to a primary upper surface of the base of the arc chute body.

7. The circuit breaker of claim 6, wherein the base of the arc chute body comprises a plurality of open slots extending between the sidewalls, and wherein the overlay material is overmolded onto the primary upper surface and sidewalls of the chute body and extends about a perimeter edge region of the slots to leave open spaces over the slots.

8. The circuit breaker of claim 1, wherein the base of the arc chute body comprises a plurality of open slots extending between the sidewalls, and wherein the overlay material extends about a perimeter edge region of the slots and leaves an open space over the slots.

9. The circuit breaker of claim 1, wherein the overlay material comprises a polyamide.

10. The circuit breaker of claim 1, wherein the overlay material comprises nylon.

11. The circuit breaker of claim 1, wherein sidewalls of the overlay member angle outward from a base of the overlay member and abut the sidewalls of the arc chute body.

12. A circuit breaker, comprising:

a metal arc chute having a base and sidewalls extending outward from the base forming an open cavity;

a movable arm holding a movable contact adjacent to the arc chute;

a line conductor electrically connected to a stationary contact residing adjacent to the arc chute facing the movable contact; and an overlay material attached to the arc chute and residing in the cavity of the arc chute, wherein the overlay material has a significantly reduced electrical conductivity relative to the metal arc chute, wherein the overlay material comprises an overlay member having a self-supportable three dimensional shape with a base and sidewalls extending outward from the base, wherein the base of the overlay member abuts a primary upper surface of the base of the arc chute body and the overlay member sidewalls reside inside the cavity adjacent the sidewalls of the arc chute body, wherein the arc chute body comprises first and second parallel slots that are orthogonal to the sidewalls, wherein the overlay member comprises first, second and third slots, the first and second slots aligned with the first and second slots of the arc chute body, and wherein the third slot is parallel to the first and second slots of the overlay member and is more narrow than the first and second slots of the overlay member.

13. The circuit breaker of claim 12, wherein the third slot of the overlay member resides between the first and second slots of the overlay member.

14. The circuit breaker of claim 12, wherein the overlay member further comprises a fourth and a fifth slot, and wherein the third, fourth and fifth slots are more narrow than the first and second slots of the overlay member.

15. A circuit breaker, comprising:

a metal arc chute having a base and sidewalls extending outward from the base forming an open cavity;

a movable arm holding a movable contact adjacent to the arc chute;

a line conductor electrically connected to a stationary contact residing adjacent to the arc chute facing the movable contact; and an overlay material attached to the arc chute and residing in the cavity of the arc chute, wherein the overlay material has a significantly reduced electrical conductivity relative to the metal arc chute, wherein the overlay material comprises an overlay member having a self-supportable three dimensional shape with a base and sidewalls extending outward from the base, wherein the base of the overlay member abuts a primary upper surface of the base of the arc chute body and the overlay member sidewalls reside inside the cavity adjacent the sidewalls of the arc chute body, and wherein the movable contact is offset from a centerline of the arc chute and resides closer to one of the overlay member sidewalls than another.

16. A circuit breaker, comprising:

a metal arc chute having a base and sidewalls extending outward from the base forming an open cavity;

a movable arm holding a movable contact adjacent to the arc chute;

a line conductor electrically connected to a stationary contact residing adjacent to the arc chute facing the movable contact; and an overlay material attached to the arc chute and residing in the cavity of the arc chute, wherein the overlay material has a significantly reduced electrical conductivity relative to the metal arc chute, wherein the overlay material comprises a rigid or semi-rigid body that has a self-supporting three dimensional shape and comprises outwardly extending projections that align with upwardly extending slots in the sidewalls of the arc chute.

17. A circuit breaker, comprising:

a metal arc chute having a base and sidewalls extending outward from the base forming an open cavity;

a movable arm holding a movable contact adjacent to the arc chute;

a line conductor electrically connected to a stationary contact residing adjacent to the arc chute facing the movable contact; and an overlay material attached to the arc chute and residing in the cavity of the arc chute, wherein the overlay material has a significantly reduced electrical conductivity relative to the metal arc chute, wherein the overlay material comprises a plurality of rigid or semi-rigid planar members that extend between the sidewalls and rise upward from the base of the arc chute to terminate below an upper end of the sidewalls.

18. A circuit breaker, comprising:

a metal arc chute having a base and sidewalls extending outward from the base forming an open cavity;

a movable arm holding a movable contact adjacent to the arc chute;

a line conductor electrically connected to a stationary contact residing adjacent to the arc chute facing the movable contact; and an overlay material attached to the arc chute and residing in the cavity of the arc chute, wherein the overlay material has a significantly reduced electrical conductivity relative to the metal arc chute, wherein the overlay material comprises a thermoplastic with a moisture absorption that is greater than 3%, has a high outgassing rate and a heat deflection temperature (under 0.45 MPa load) that is greater than 250° C.

19. An arc chute for a circuit breaker, comprising:

a unitary metal arc chute body having a three dimensional shape with a base and first and second sidewalls with a cavity between the sidewalls above the base; and an overlay material residing in the cavity of the arc chute body, wherein the overlay material resides directly on the base and at least partially against inner surfaces of the sidewalls of the arc chute body, and wherein the overlay material has a significantly reduced electrical conductivity relative to the metal arc chute, wherein the overlay material comprises a thermoplastic with a moisture absorption that is greater than 3%, has a high outgassing rate and a heat deflection temperature (under 0.45 MPa load) that is greater than 250° C.

20. The arc chute of claim 19, wherein the overlay material comprises a rigid or semi-rigid overlay body with a base and sidewalls, and wherein the base of the overlay body resides between the sidewalls of the arc chute body over the base.

21. The arc chute of claim 20, wherein the base of the arc chute body comprises a plurality of open slots extending between the sidewalls, and wherein the overlay member comprises a plurality of open slots with at least one of the slots of the overlay member aligned with at least one of the slots of the arc chute body.

* * * * *